United States Patent [19]

Sassak

[11] 4,172,376

[45] Oct. 30, 1979

[54] MULTIPLE STATION TUBE BENDER

[76] Inventor: Frank Sassak, 2115 Howard St., Detroit, Mich. 48216

[21] Appl. No.: 927,165

[22] Filed: Jul. 21, 1978

[51] Int. Cl.[2] ..... B21D 7/024; B21D 43/00

[52] U.S. Cl. ..... 72/306; 72/405; 72/461

[58] Field of Search ..... 72/24, 217, 218, 306, 72/405, 449, 461

[56] References Cited

U.S. PATENT DOCUMENTS

| | | | |
|---|---|---|---|
| 2,366,012 | 12/1944 | Draper et al. | 72/217 |
| 2,510,183 | 6/1950 | Luce | 72/217 |
| 3,438,237 | 4/1969 | Sisler | 72/217 |

*Primary Examiner*—Michael J. Keenan

*Attorney, Agent, or Firm*—Cullen, Sloman, Cantor, Grauer, Scott & Rutherford

[57] ABSTRACT

A multiple station tube bender includes a rotatable table upon a platform adapted for incremental rotary movements and for intermittent raising and lowering. The horizontally disposed support rod is adapted to axially mount a tubular workpiece to be bent. A radially extending rod support is mounted upon the table for journalling the rod and including a gear mechanism for variably rotating the support rod for angular orientation of the workpiece before bending. A series of spaced bending stations are arranged around the platform, each including a bending brake assembly at varying center distances from the table and adapted for successive and progressive forming of bends in the workpiece at spaced points along its length. After each bend, the table automatically elevates and rotates the workpiece in a horizontal plane to the next bending station and lowers the workpiece into registry with the bending brake. A gear mechanism upon the rod support effects automatic rotaton of the workpiece to a predetermined angle for the next successive bend. The bending brakes at all bending stations are adapted to act simultaneously on an adjacent workpiece so that there is a continuous intermittent delivery of workpieces in final form at the final bending station during continuous intermittent rotary movements of the table.

21 Claims, 11 Drawing Figures

FIG. 2
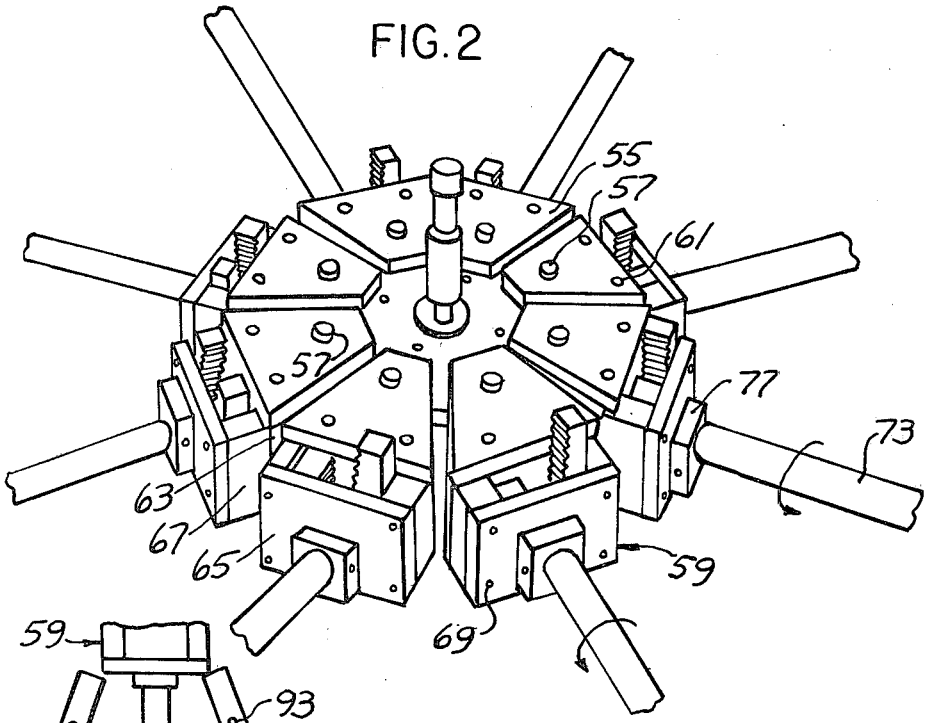
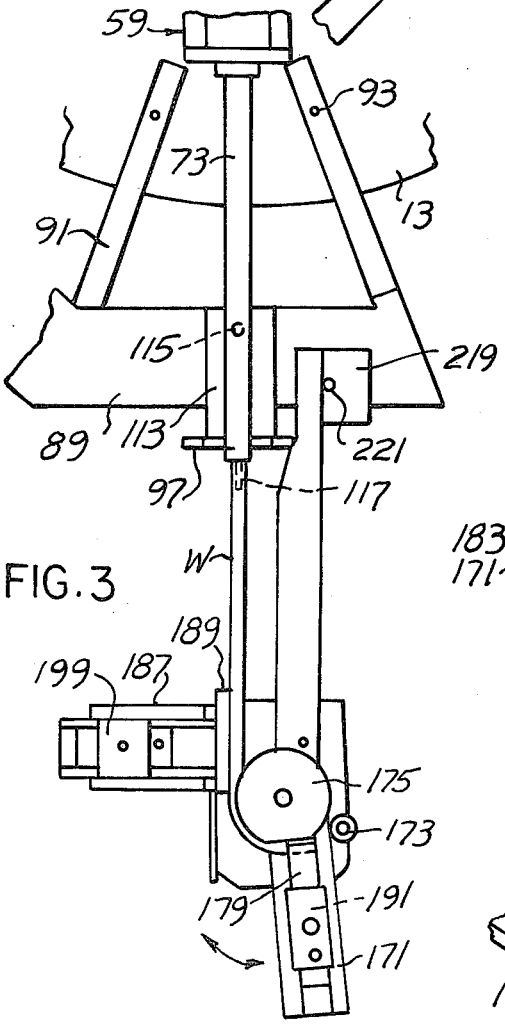
FIG. 3
FIG. 4
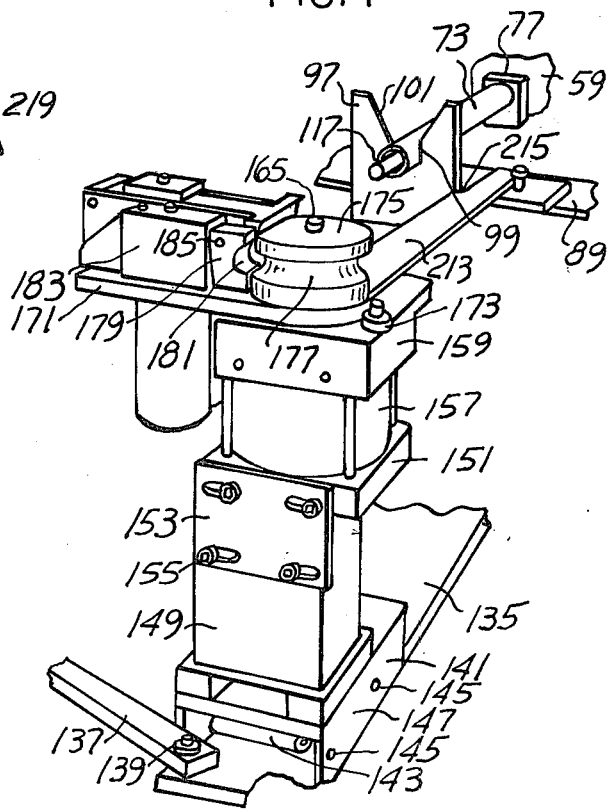

MULTIPLE STATION TUBE BENDER

BACKGROUND OF THE INVENTION

Heretofore, in the art, there has been the need for forming upon a tubular workpiece of a series of equal or unequal bends along the length thereof spaced at different distances from each other and angularly oriented with respect to each other and wherein, there is a need for mass production of such tubular workpieces having a series of such bends therein. One example is in the auto industry in the manufacture of exhaust pipes or tail pipes, and many other areas wherein, tubes are required having a series of angularly related bends formed therein.

Heretofore, there have been very complicated machines constructed by which tubular workpieces may have formed therein a series of longitudinally spaced bends of the same or different radii and angularly related with respect to each other. The primary difficulty with the prior art efforts at devices of this type has been the expensive and extensive and complicated nature of the mechanisms and control devices involved.

SUMMARY OF THE INVENTION

It is an object of the present invention to provide an improved and simplified multiple station tube bender by which there is provided a series of tube bending stations around a rotary table and wherein, the rotary table mounts a series of support rods for radially extending workpieces and wherein, in a continuous manner as the table rotates, there will be a continuous intermittent and progressive formation of successive bends on the workpieces simultaneously thus, providing a continuous intermittent delivery of workpieces in final form at the final bending station, all in a continuous operation.

It is another object to provide an improved multiple station tube bender and wherein, a series of tubular workpiece blanks may be successively mounted upon a series of support rods and wherein, during intermittent incremental rotary movements of the table, there will be intermittent raising and lowering of the table for disengaging a workpiece from a bending brake assembly at a particular bending station and to facilitate movement of the workpiece to the next adjacent bending station for a successive bend therein.

It is another object to provide an automatic mechanical control mechanism by which after each bend in a workpiece, the workpiece will be angularly oriented a predetermined amount in one direction or the other before the next succeeding bend has been applied thereto.

These and other objects will be seen from the following specification and claims in conjunction with the appended drawings.

THE DRAWINGS

FIG. 2 is a fragmentary perspective view on an enlarged scale of the multiple station tube bender shown in FIG. 1.

FIG. 3 is a fragmentary plan view of one bending station showing the associated support rod and with the bending brake rotated for forming a bend in the workpiece.

FIG. 4 is a front perspective view of one bending station, on an enlarged scale including a movably mounted pedestal and a bending brake assembly.

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
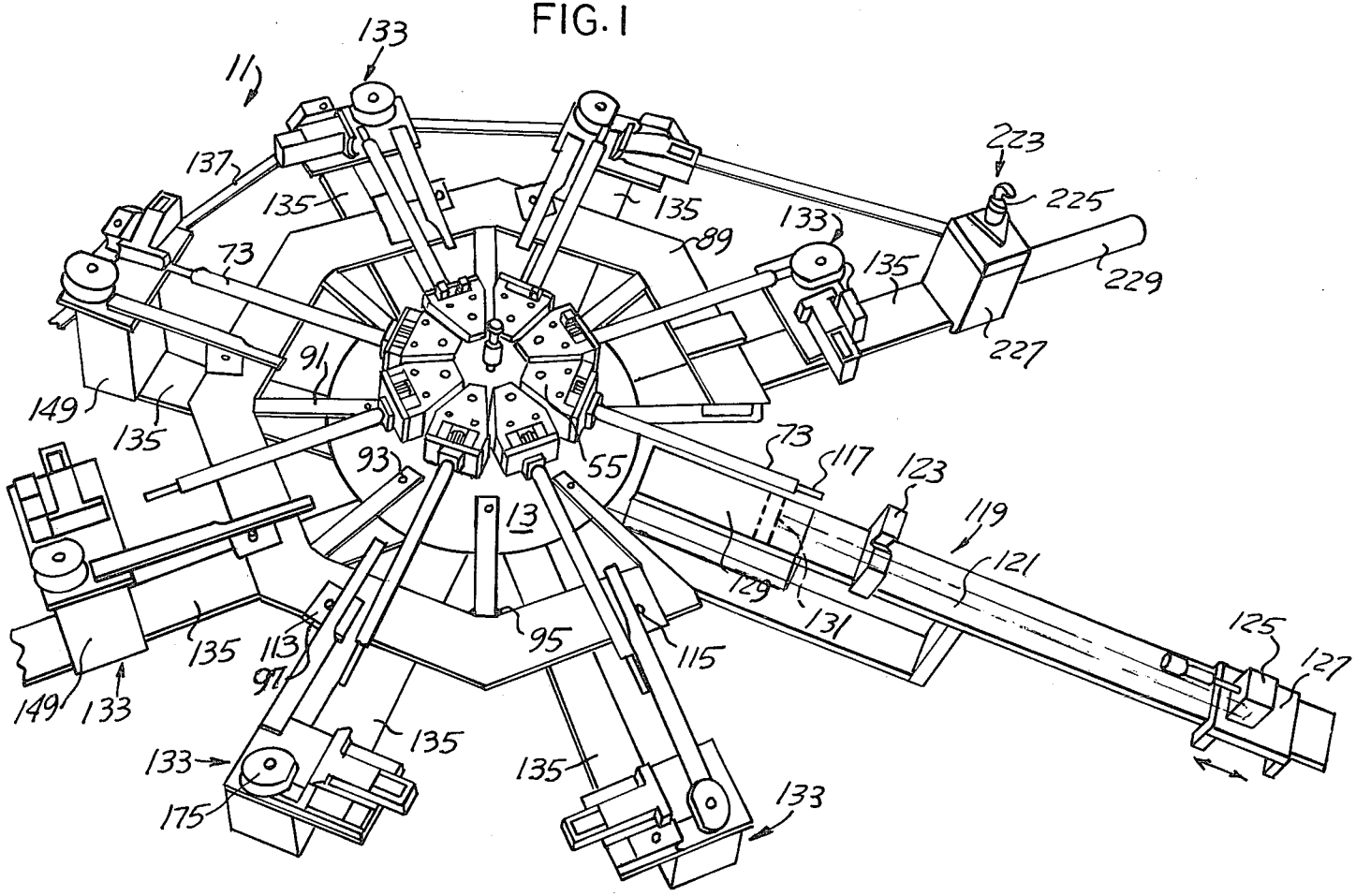
FIG. 1 is a fragmentary perspective view of the present multiple station tube bender.
Figure 5:
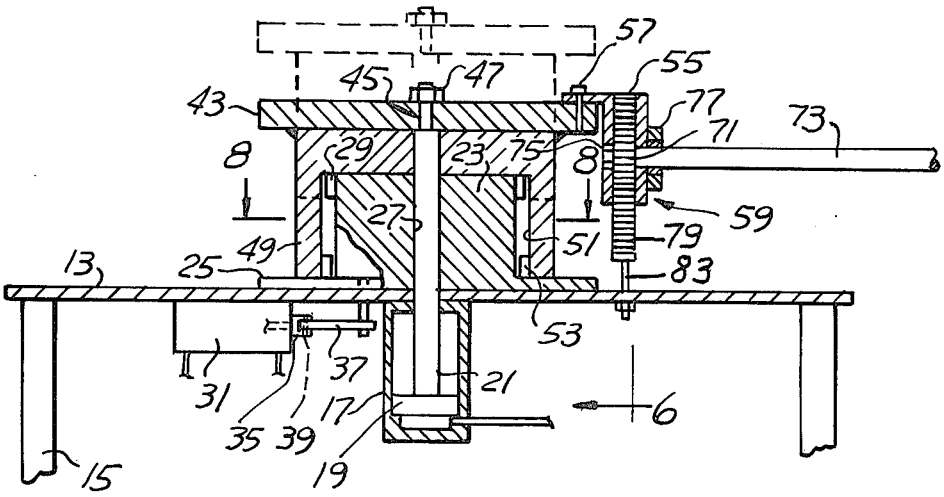
FIG. 5 is a fragmentary vertical section of the tube bender showing the mounting of the table on its platform for rotary and vertical adjustments.
Figure 10:
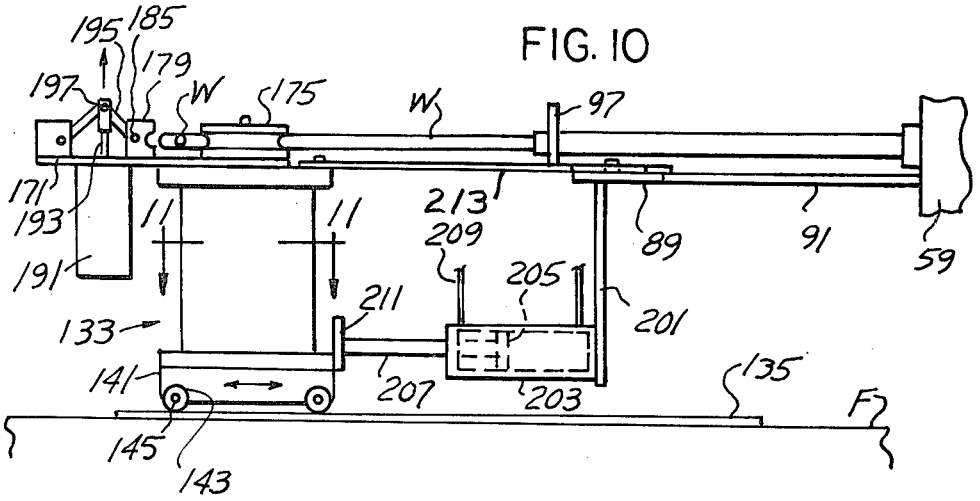
FIG. 10 is a side elevational view of the bending station shown in FIG. 9, including the power control for radial adjustments of the bending brake assembly supporting pedestal.

Referring to the drawings, the present multiple station tube bender is generally indicated at 11, FIG. 1, upon the floor surface F, FIG. 10, including support platform 13, FIG. 5, having a supporting frame 15 fragmentarily shown for spacing the platform above the floor surface.

The upright table lift cylinder 17 is secured upon the under surface of platform 13 and includes a reciprocal piston 19 with connected piston rod 21 arranged upon a vertical central axis. Said piston rod extends up through platform 13 and at its upper end mounts and is secured to table 43 as by fastener 47, FIG. 5.

Rotative feed device 23 of cylindrical form has a circular base flange 25 with said feed device and flange supported upon platform 13 and adapted for incremental rotary reciprocal movements.

Figure 8:
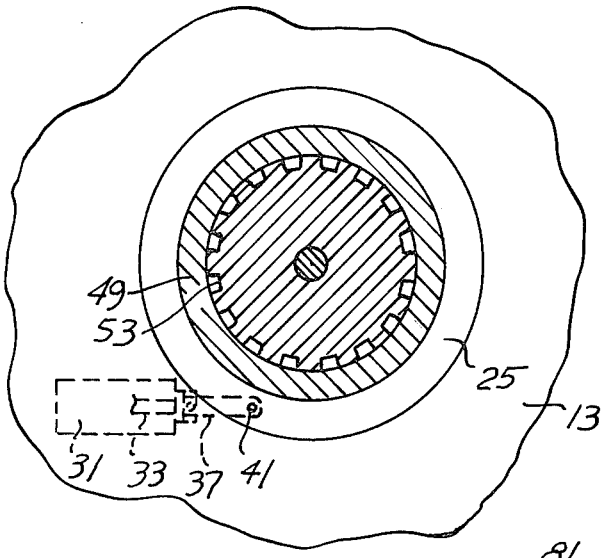
FIG. 8 is a fragmentary section taken in the direction of arrows 8—8 of FIG. 5.

Ring gear 29 is secured around an upper end portion of the rotative feed device. The second feed cylinder 31, hydraulic or pneumatic, is secured to the undersurface of platform 13 and has an axis at right angles to and laterally displaced from central axis of the piston rod 21, said piston rod being journalled through the upright bore 27 in said rotative feed device. Cylinder 31 includes a piston and connected piston rod 33 which projects from said cylinder and by a clevis 35 is pivotally connected to the link 37. Pivot pin 41 on the outer end of said link is eccentrically connected to flange 25, FIG. 8. Therefore, activation of the cylinder 31 at its opposite ends in a conventional manner is adapted to effect intermittent reciprocal movements of the link 37 and corresponding intermittent reciprocal rotary movements of the rotative feed device 23.

Table 43 has a central bore 45 to receive the upper reduced end portion of piston rod 21, and includes annular apron 49 having a bore 51 which receives the rotatable feed device, FIG. 5. Ring gear 53 is arranged within said bore upon said apron at the lower end thereof and is normally spaced from ring gear 29.

A series of wedge-shaped rod support plates 55 are spaced around the table 43 to extend radially outward therefrom and are pivotally connected thereto as by the fasteners 57, as shown in FIGS. 2 and 5. Each rod support plate at its outer end has a depending gear box 59, FIGS. 5, 6 and 7, secured to the respective rod support 55 as by fasteners 61.

Each gear box includes upright back plate 63, FIG. 2, front plate 65, and spacers 67 assembled together by fasteners 69, FIG. 2.

Figure 7:
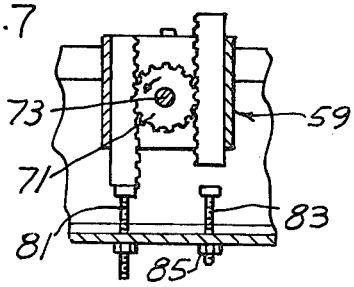
FIG. 7 is a similar view of such control mechanism as arranged upon the opposite side of the table from that shown in FIG. 5.
Figure 6:
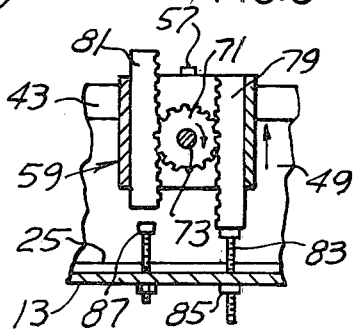
FIG. 6 is a fragmentary section taken in the direction of arrows 6—6 of FIG. 5, illustrating the device for controlling angular orientation of the workpiece.

Pinion 71, FIGS. 6 and 7, is journalled within the gear box as by bearings 75, FIG. 5, and external bearing block 77 which receives and journals the workpiece support rod 73. Said support rod axially projects into and is secured to said pinion, as shown in FIGS. 5 and 6.

Upright first rack gear 79 is in mesh with pinion 71 and slidably engages one side wall of the gear box, and is adapted for vertical adjustments along with vertical movements of the table 43 with respect to the axially aligned adjustable stop 83, FIG. 6.

A second upright rack gear 81 is arranged upon the opposite side of the gear box, FIGS. 6 and 7, is in mesh with said pinion and slidably engages the opposite side of said gear box.

As shown in FIG. 6, the second rack gear 81 is normally spaced from but in axial registry with a second adjustable stop 87 secured upon platform 13.

As explained hereunder, vertical adjustments of the table 43 will effect corresponding vertical adjustments of the respective gear boxes at the outer ends of the respective rod supports. As one of the rack gears 79 or 81 comes into registry with either of the adjustable stops 83 or 87, upon downward movement of the table 43, further downward movement of said table will cause an angular rotary adjustment of the pinion 71 and the connected support rod 73 for a predetermined angular rotation thereof and a corresponding angular adjustment of the tubular workpiece W axially secured thereto, as in FIGS. 3, 9 and 10.

Figure 9:
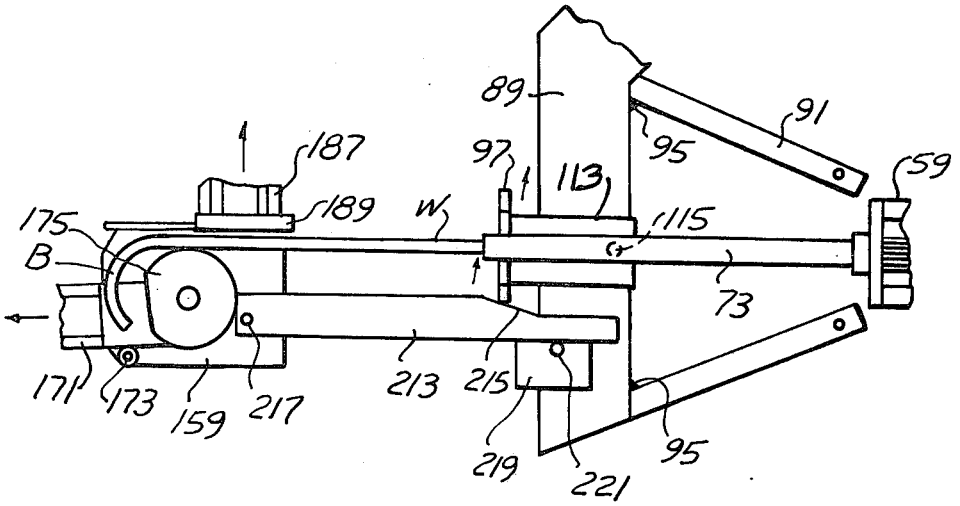
FIG. 9 is a plan view similar to FIG. 3, showing the position of the bending brake after bending and with the workpiece laterally disengaged from the bending die.

Arranged around the platform 13 and outwardly thereof is the horizontally disposed hollow ring platform 89 secured thereto by a series of spokes 91 and corresponding fasteners 93, FIGS. 1 and 3. The outer ends of said spokes are normally connected to the ring platform by a series of welds 95, as shown in FIG. 9, or other equivalent fastening device.

A series of upright rod supports 97 having upwardly opening sockets 99, FIGS. 1, 3, 4, 9 and 10, have mounting plates 113 which overly ring platform 89 and are spaced therearound and are pivotally connected thereto upon a vertical axes as at 115.

The outer end of the respective support rods 73 have reduced diameter mandrels 117 adapted to frictionally receive end portions of the respective workpieces W so that the workpieces are held in axial alignment with the rods 73, such as shown in FIG. 3.

As shown in FIG. 1, there is provided a radially arranged load station 119 which includes upon the floor surface a radially extending elevated platform 121 mounting an upright notched workpiece support 123. This would normally hold one end of the tubular workpiece W in longitudinal registry with mandrel 117.

Workpiece pusher 125 is aligned with notched support 123 as well as with the support rod 73 and is mounted upon the radially adjustable table 127 suitably connected to a movable piston rod 131 of the cylinder 129. This provides illustratively one means by which the table 127 may be advanced and retracted for engaging a tubular workpiece blank W and sliding it along the support 123 into frictional cooperative and securing registry with the mandrel 117 for loading the tubular workpiece blank upon support rod 73 in alignment therewith.

A series of spaced bending stations 113 are mounted upon the floor surface F radially outward of and around the platform 13, as best shown in FIG. 1. These stations are each equally spaced apart from each other and with respect to the loading station 119. A series of flat radially extending tracks 135 are applied to the floor surface and extend radially outward from the framework 15 of the platform 13 and are adapted to supportably underly the respective bending stations 133.

The outer ends of adjacent tracks 135 are interconnected by the spacer links 137 and corresponding fasteners 139, such as shown fragmentarily in FIG. 4.

Each of the bending stations includes a carriage 141 and journalled thereunder at 145 a pair of transverse rollers 143 adapted to engage the respective tracks 135 to facilitate adjustments and reciprocal movements of the respective bending stations and associated carriage 141. Mounted upon each carriage is an upright pedestal 149.

The lower cylinder head 151 of the bending cylinder 157 is secured above and is adjustably mounted upon pedestal 149 as by the mounting plate 153 and corresponding fasteners 155. The bending cylinder includes the top support head 159 upon which the present bending brake assembly is mounted.

Figure 11:
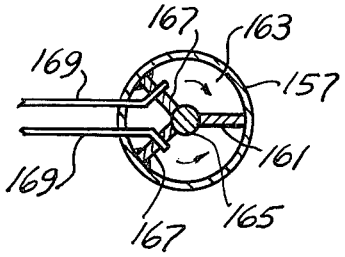
FIG. 11 is a fragmentary section of the bending brake control cylinder taken in the direction of arrows 11—11 of FIG. 10.

The detail of construction of the bending cylinder 157 is shown in FIG. 11 as including a cylindrical chamber 163 and an axial rotative rod 165 which is journalled with respect to the upright radial angularly related partitions 67.

Piston plate 161 is arranged in a vertical plane and is adapted for reciprocal movements in vertical planes and at one upright edge is secured to the rotative rod 165.

Pressure fluid conduits 169 extend to the cylinder 157 and project through the respective partitions 167 for pressurizing chamber 163 selectively upon opposite sides of the piston plate 161 for effecting controlled reciprocal rotary movements thereof in a conventional manner.

The present bending brake assembly includes the laterally extending bending brake 171 which, at one end, overlies support head 159, receives and is secured to the rotatable piston rod 165 forming a part of the bending cylinder.

The bending brake assembly includes the replacable and interchangeable circular bending die 175 mounted on rod 165, which has an exterior annular groove 177 therein to correspond to the diameter of the selected workpiece.

The bending brake includes workpiece-engaging jaw 179 grooved at 181 to receive the workpiece and pivotally mounted at 185 to the block 183. The bending brake assembly also includes a laterally extending support plate 187, FIG. 3, which mounts the radially adjustable grooved gripper jaw 189.

Cylinder 191, FIG. 10, depends from the bending brake 171 and includes a reciprocal piston and piston rod 193.

Control link 195 is pivoted at 197 to said piston rod and at its other end is pivoted at 185 to jaw 179, as shown in FIG. 4, so that vertical adjustments of piston rod 93 will control gripping and ungripping movements of the jaw 179.

Similar to the control cylinder 191 for the jaw 179 of the bending brake, there is provided an additional cylinder assembly 199. That cylinder assembly also has a reciprocal piston and piston rod and a linkage similar to the linkage shown in FIG. 10 for operatively connecting the workpiece-gripping jaw 189 and securing an end portion of the workpiece W with respect to the bending die 175 within the annular groove 177 therein, such as shown in FIG. 3.

After each bending function of the bending brake and before retraction thereof from the position shown in FIG. 3 to the position shown in FIG. 4, there will be a limited radial inward movement of the pedestal 149 and carriage 141 at each bending station and with respect to the track 135.

Referring to FIG. 10, upright bracket 201 depends from the ring platform 89 and secures the horizontally disposed radially extending cylinder 203 with suitable control conduits 209 connected at opposite ends thereof for effecting reciprocal movements of the piston 205 and the connected projecting piston rod 207.

The free end of said rod is connected by the bracket 211 to the carriage 141 of the pedestal 149 of each bending station. After the bending operation shown in FIG. 4, cylinder 203 is activated causing a retraction of the carriage 141 a limited distance upon the supporting track 135.

Cam arm 213, FIG. 9, having a cam 215 adjacent one end, at its other end is pivotally mounted as at 217 upon support head 159.

The opposite end of the cam arm 213 is movably supported upon the ring platform 89 and slidably engages the guide pin 221 upon plate 219 upon said platform. The cam 215 of the cam arm 213 is in operative engagement with the pivotal rod support 97.

Accordingly, after the bending brake, fragmentarily shown at 171, FIG. 9, has completed the bending and formed the bend B in the tubular workpiece, cylinder 203 is activated causing a retraction of the piston rod 207 and an inward movement of the carriage 141. This causes a corresponding radial inward movement of the cam arm 213 so as to operatively engage the socketed rod support 97 rotating said rod support around its pivot mounting 115 from the position shown in FIG. 4 to a lateral position, FIG. 9, so that the workpiece W has become disengaged from the bending die 175.

So disengaged, the next upward adjustment of the central table 43 will cause an upward movement of the workpiece W and its support rod 73 in a vertical plane as properly disengaged from the bending die 175.

An unloading station is generally indicated at 223, FIG. 1, and is arranged radially outward of the final bending station 133 and includes a formed workpiece gripping device 225 upon the support 227.

When the particular workpiece upon its rod support has been rotated to the unloading position shown in FIG. 1 with respect to the unloading station 223, the gripper 225 is adapted to operatively engage the formed tubular workpiece and a control mechanism 229 is adapted to retract the support 227 sufficiently to disengage the workpiece from the final bending station 133.

OPERATION

After the loading of a tubular workpiece blank W upon the mandrel 117 at the loading station 119, FIG. 1, cylinder 17 under a remote control raises the table 43 such as to the dash position shown in FIG. 5 and when so elevated, the internal ring gear 53 is then in mesh with the rotative feed device ring gear 29. Accordingly, in successive operation of the cylinder 31 and its piston rod, there will be an incremental rotary movement of the rotative feed device 23 causing a corresponding angular rotary movement of the table 43 such that the connected rod support 55, the support rod 73 and the associated workpiece are rotated from the loading station to the first bending station in a clockwise direction, shown in FIG. 1.

The link 37 connected with cylinder 31 and eccentrically joined to the flange 25 on the rotative drive device 23 functions as a ratchet so that on each activation of the cylinder there is, when the table 43 is elevated, corresponding equal incremental rotary movement of the table in the same direction so that ultimately the table rotates 360 degrees. This causes the particular workpiece to intermittently move from one station to another until the workpiece reaches the unloading station 223, FIG. 1.

Accordingly, the bending stations including the loading station 119 and the uloading station 223 are spaced apart equal amounts so that uniform rotary incremental adjustments of the flange 25 and the associated rotative control device will cause similar incremental rotary adjustments of table 43 and the respective rod supports 55 mounted thereon. Retraction of link 37 and drive device 23 occurs after table 43 is lowered and gears 29,53 disengaged.

When the workpiece reaches the first bending station 133, the table 43 under the control of the control of cylinder 17 is automatically lowered which causes a corresponding lowering of the respective rod support plates 55 and the corresponding gear boxes and associated rack gears 79 and 81.

Depending upon the desired amount of angular orientation of the workpiece for a particular successive bend, the respective adjustable stops 83 and 87 are arranged upon the platform 13, with one of the adjustable stops 83,87 adapted for operative engagement with one of the rack gears 79 and 81. Therefore, upon such lowering of the table 43 as brings one of the rack gears 79 or 81 into engagement with the corresponding adjustable stop, further lowering of the table will cause the associated pinion 71 and support rod 73 to rotate a predetermined amount, depending upon the setting of the adjustable stops. One stop is active and the other stop is inactive.

With the workpiece support rod 73 properly oriented for a particular bend, the tubular workpiece is now in registry with the bending die 175 of the bending brake assembly shown in FIG. 4. Cylinder 199 is activated, causing the jaw 189 to grip the outer end portion of the workpiece W with respect to the bending die. Activation of the second cylinder 191, FIG. 10, causes the jaw 179 to operatively engage the tubular workpiece. The bending brake cylinder 157 is now energized by supplying pressure fluid to one of the conduits 169 of FIG. 11, causing a rotary movement of the piston plate 161 and the associated rod 165. This causes a rotary adjustment of the bending brake 171, limited by its engagement with the adjustable stop 173, FIG. 4. This produces the bend in the tubular workpiece, such as shown at B, FIG. 9.

During bending of the workpiece, the support rod 73, at its free end, has been supported within the socket 99 of the upright plate 97 which includes inclined guiding surfaces 101.

Before the workpiece can be elevated for rotation to the next adjacent station, it must first be disengaged from the bending die 175 in the manner shown in FIG. 9. This is accomplished by activation of the cylinder 203 which causes a radial retraction of the carriage 141 and the associated bending brake assembly and the cam arm 213, causing a slight pivotal movement of the rod support 97 about the pivot 115. This causes a slight lateral disengagement of the workpiece W from the bending die 175, clearing it for a subsequent vertical adjustment. At that time, the cycle repeats and the cylinder 17 is again activated to elevate the table 43 and associated support rod 73 and workpiece.

In the operation of the present multiple station tube bender as there are provided incremental rotary movements of the respective support rods 73, additional workpieces W are assembled onto each support rod so that eventually the bending stations will be functioning simultaneously for progressively forming additional successive bends in the tubular workpiece respectively, as it is rotated around platform 13 from the first station shown in FIG. 1 to the final station which corresponds to the unloading station 223. Thus, the present tube bender functions like a pin wheel with the table 43 adapted for intermittent raising and lowering movements and with intermittent incremental rotary movements and with the workpiece support adapted for intermittent angular rotary adjustments for proper angular orientation of the workpiece for the next succeeding bend, as the workpiece progresses around the multiple station tube bender.

Thus, corresponding to the stations involved, each station will apply a successive additional bend to the workpiece at a predetermined spacing along the length of the workpiece and angularly oriented with respect to each other until the final product has been completed.

Since the bending stations are operating simultaneously, each bending station will form its particular bend in the adjacent workpiece supported with respect thereto.

Since the bends are spaced along the length of the tubular workpiece blank, the corresponding bending stations are angularly arranged at different center distances with respect to the center of the table 43, corresponding to the desired spacing of the bends.

Having described my invention, reference should now be had to the following claims.

I claim:

1. A multiple-station tube bender comprising a support platform upon and spaced above a floor surface;

a rotatable table mounted on said platform;

means journalling said table for incremental rotary movements about a central axis;

means for raising and lowering said table relative to said platform;

a horizontally disposed workpiece support rod extending radially outward of said table at one end adapted to frictionally receive and support a horizontally disposed tubular workpiece to be bent;

a radially extending rod support pivotally mounted upon said table supporting and journalling said rod;

gear means on said support connected to and adapted to variably rotate said support rod for angular orientation of the workpiece;

a series of spaced bending stations upon said floor surface radially outward of and around said platform;

and a bending brake assembly at each station at varying center distances from said table;

each bending brake assembly adapted for successive and progressive axial registry with said rod support and workpiece for forming successive bends in said workpiece at spaced points along its length;

said table after each bend elevating the workpiece in a vertical plane, successively rotating said workpiece to the next adjacent bending station, and lowering said workpiece for registry with the adjacent bending brake;

said gear means automatically rotating said workpiece a predetermined angle for its next successive bend;

said bending brake center distance progressively decreasing corresponding to the respective longitudinal spacing of the successive bends along the length of said workpiece.

2. In the tubular bender of claim 1, the means for journalling and raising and lowering said table including a cylinder aligned with said axis and secured to the undersurface of said platform;

a piston in said cylinder having a piston rod projecting through said platform along said axis and at its end secured to said table, and pressure means connected to said cylinder for intermittently raising and lowering said piston.

3. In the tube bender of claim 1, said table having an annular apron defining a cylindrical chamber;

the means for effecting said rotary movements including a rotatable feed device of cylindrical form;

an annular flange at one end of said feed device;

said feed device and flange bearing upon said platform and nested within said apron;

a second cylinder secured upon the undersurface of said platform with its axis at right angles to and laterally displaced from said first cylinder;

a piston in said cylinder having a piston rod and eccentrically connected to said flange;

pressure means connected to said second cylinder for intermittently reciprocating its piston rod and effecting intermittent reciprocal rotary movements of said feed device;

and gear means on said feed device and apron normally non-meshing, and adapted for meshing on raising of said table, whereby incremental table rotary movement follows raising of said table.

4. In the tube bender of claim 1, the forward incremental rotary movements of said table being uniform so that each incremental rotary movement causes a corresponding rotary movement of said rod support and tubular workpiece into registry with the bending brake assembly at each succeeding bending station, and whereby upon completion through the final bending station, the tubular workpiece has therein a series of angularly oriented bends along its length.

5. In the tube bender of claim 1, the mounting of said workpiece upon said support rod including a mandrel of reduced diameter at one end of said support rod over which the workpiece is axially and frictionally projected.

6. In the tube bender of claim 1, a plurality of additional radially extending rod supports pivotally mounted upon said table around its circumference;

each rod support mounting a radial support rod adapted for axially supporting a tubular workpiece, the rod supports, support rods and workpieces being angularly related corresponding to the angular relation of said bending stations, so that the bending brakes of all bending stations are adapted to act simultaneously on an adjacent workpiece and further, so that there is a continuous intermittent delivery of workpieces in final form at the final bending station during continuous intermittent rotary movements of said table.

7. In the tube bender of claim 1, said gear means including a gear box at the end of and depending from said rod support;

a pinion journalled within said gear box and axially connected to said support rod;

a vertically adjustable rack gear in mesh with said pinion and slidably engaging said gear box;

said gear box adapted for raising and lowering with said table;

and a series of spaced upright adjustable stops upon said platform in radial registry with each bending station, and respectively in axial registry with said rack gear when said rod support and support rod has been rotated into registry with said station;

whereby upon downward movement of said table and gear box, and engagement of said rack gear with a stop, continued downward movement of said gear box effects a predetermined rotation of said pinion gear and connected support rod and workpiece.

8. In the tube bender of claim 7, each adjustable stop being preset for the predetermined desired angular rotation of the workpiece before bending thereof, whereby each bend in the workpiece after the first bend is angularly oriented with respect to the previous bend.

9. In the tube bender of claim 7, a second rack gear in mesh with said pinion and slidably engaging the opposite side of said gear box;

and a second series of spaced upright adjustable stops on said platform in radial registration with each bending station, and in respective axial registry with said second rack gear when said rod support and support rod have been rotated into registry with one station, the respective first and second adjustable stops being selectively usable corresponding to each station, depending upon the desired direction of workpiece rotation at that station, the other of said adjustable stops at that station being inoperative.

10. In the tube bender of claim 3, said gear means on said feed device including a first ring gear upon the interior of said apron;

and a second ring gear upon the exterior of said rotative drive device, normally spaced from said first ring gear;

raising of said table and apron bringing said first ring gear into mesh with said second ring gear.

11. In the tube bender of claim 1, each bending station including a pedestal upon said floor surface adjustably mounting a bending brake assembly;

said assembly including a removable replaceable circular bending die of a predetermined diameter and grooved to match the workpiece diameter;

retractable clamping means on said pedestal for securing said workpiece against said bending die;

and a rotatable retractable bending brake mounted on said pedestal coaxial to said bending die, for slidably engaging the workpiece and on rotation forming a bend thereon of a predetermined arc.

12. In the tube bender of claim 11, an adjustable stop on said pedestal, limiting rotary movements of said bending brake.

13. In the tube bender of claim 11, said bending brake including a bend cylinder adjustably mounted upon said pedestal;

an axial piston rod journalled within said cylinder and connected to said bending brake;

and an upright piston plate within said bend cylinder lying in a vertical plane, along one upright edge connected to said piston rod whereby, alternate pressurization of said bend cylinder upon opposite sides of said piston effects reciprocal rotary movements of said bending brake.

14. In the tube bender of claim 1, each bending station including a pedestal adjustably mounting a bending brake assembly having a bending brake and a bending die;

a ring platform spaced outwardly of and concentric to said support platform and connected thereto;

an upright socketed rod support rotatably mounted upon a vertical axis upon said ring platform adapted to supportably receive an outer end portion of said support rod during bending of said workpiece;

and a movable cam means upon said ring platform, after tube bending and release of said tube by said bending brake, adapted to effect a limited rotation of said support rod, laterally disengaging said workpiece from the bending die before raising of said table, support rod and workpiece.

15. In the tube bender of claim 14, said pedestal being movably mounted upon said floor surface for limited radial movements towards and away from said ring platform;

said cam means including a cam arm at one end pivotally connected to said pedestal and at its other end, guidably mounted upon said ring platform;

a cam on said arm bearing against said socketed rod support;

and power means on said ring platform and connected to said pedestal for radially retracting said pedestal, causing a retraction of said arm and cam to operatively engage said socketed rod support.

16. In the tube bender of claim 15, rollers journalled upon the under surface of said pedestal engaging the ground surface.

17. In the tube bender of claim 16, said latter power means including a cylinder connected to said ring platform and having a reciprocal piston and piston rod, said piston rod connected to said pedestal.

18. In the tube bender of claim 16, a series of spaced radially extending roller-supporting tracks underlying the pedestal at each bending station, facilitating radial movements of each pedestal.

19. In the tube bender of claim 18, a series of spacer links respectively interconnecting the outer ends of adjacent tracks.

20. In the tube bender of claim 1, a loading station uniformly spaced between the first and last bending stations;

including a radial platform aligned with said support rod;

an upright notched support for mounting a workpiece blank in registry with said support rod;

and a workpiece pusher slidably mounted upon said radial platform for moving the workpiece tubular blank into secured registry with said support rod.

21. In the tube bender of claim 1, a workpiece unloading station radially outwardly of the final bending station;

and a radially movable unloader adapted to grip the finished workpiece axially withdrawing it from said final bending station.

* * * * *